United States Patent [19]

Cauffiel

[11] 4,019,282

[45] Apr. 26, 1977

[54] APPARATUS FOR DESCALING METAL STRIPS

[76] Inventor: Ford B. Cauffiel, 1400 Hastings Ave., Toledo, Ohio 43607

[22] Filed: Mar. 14, 1975

[21] Appl. No.: 558,282

[52] U.S. Cl. ..... 51/75; 51/169

[51] Int. Cl.[2] ..... B24B 7/12

[58] Field of Search ..... 51/74 R, 75, 76 R, 78, 51/80 A, 81 R, 87 R, 169, 137–139; 29/81 H, 81 J

[56] References Cited

UNITED STATES PATENTS

| | | | |
|---|---|---|---|
| 1,288,064 | 12/1918 | Lewis | 51/87 R X |
| 1,929,101 | 10/1933 | Schulte | 51/78 X |
| 2,199,135 | 4/1940 | Johnston | 51/74 R |
| 2,316,582 | 4/1943 | Hercik | 51/74 R |
| 2,666,282 | 1/1954 | Peterson | 51/87 R X |
| 2,759,301 | 8/1956 | Valette | 51/75 X |
| 2,881,570 | 4/1959 | Moore | 51/87 R |
| 3,662,620 | 5/1972 | Carlson | 51/169 X |

*Primary Examiner*—Al Lawrence Smith
*Assistant Examiner*—Nicholas P. Godici
*Attorney, Agent, or Firm*—Allen D. Gutchess, Jr.

[57] ABSTRACT

An apparatus is provided for descaling hot rolled steel strips or sheets by abrasion. This is preferably accomplished with an abrasive roll, which comprises a hub having a multiplicity of abrasive sheets extending generally radially therefrom and rotated at high speed with outer edges in contact with the metal strip moving thereby. The abrasive roll can have a length less than the width of the strip with means provided for maintaining one end of the abrasive roll in alignment with one longitudinal edge of the strip. This improves the life of the abrasive sheets since they do not move transversely over the longitudinal edge of the strip. The steel strip also can be supported in a curved manner to present a convex surface toward the abrasive roll when in contact therewith. The bent configuration of the strip helps to loosen the scale and hastens the descaling operation. For a lower production and lower cost descaling operation, one abrasive roll can be used with the steel strip coiled and uncoiled in a manner to present opposite surfaces toward the abrasive roll when it is moved thereby in two passes. To further improve the life of the abrasive roll, it is periodically checked to determine its condition of balance. Weights can then be added to the hub to restore the balanced condition, as necessary. A back-up roll for supporting a steel strip in contact with the abrasive roll can have metal collars supporting edge portions of the strip to prevent undue wear of the back-up roll.

12 Claims, 12 Drawing Figures

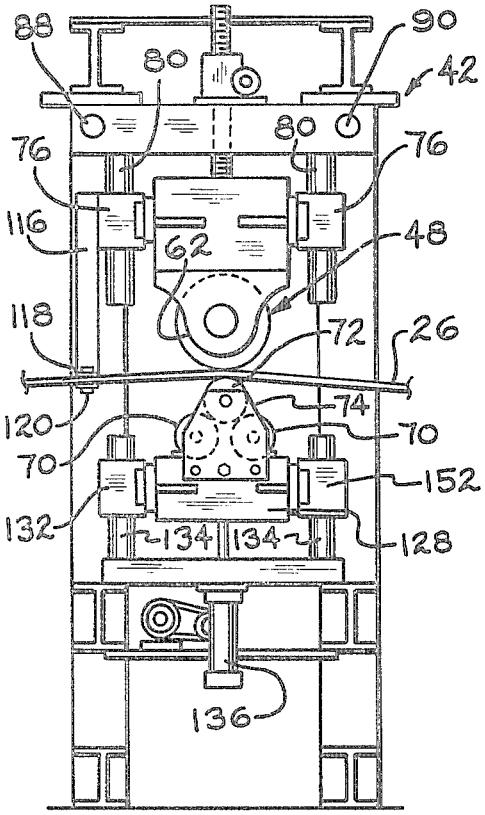
FIG. 5
FIG. 7
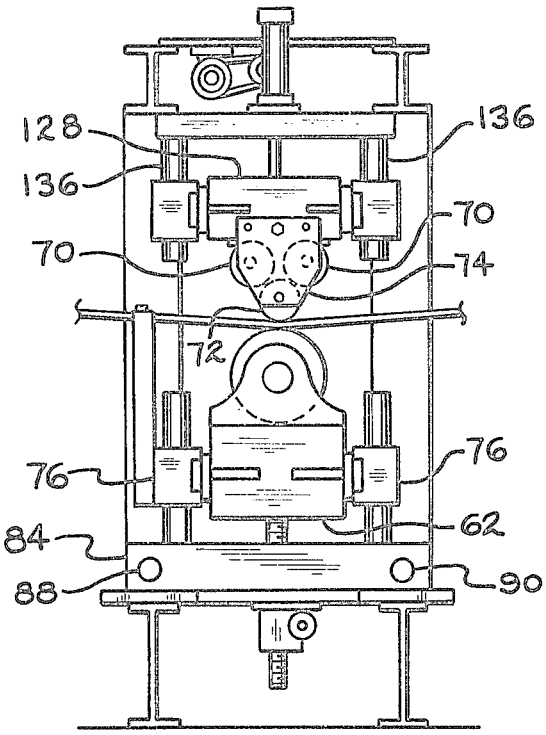
FIG. 11
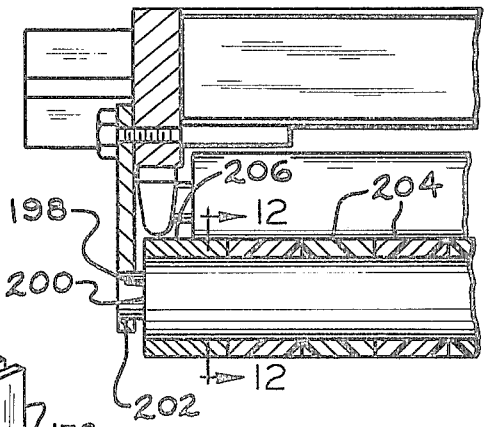
FIG. 12
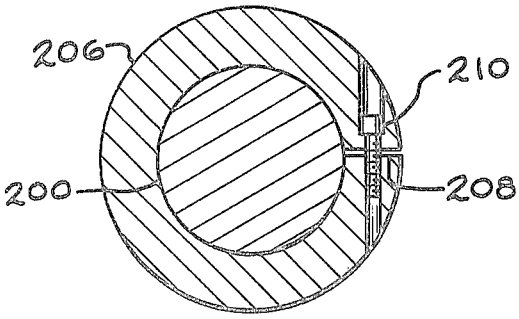
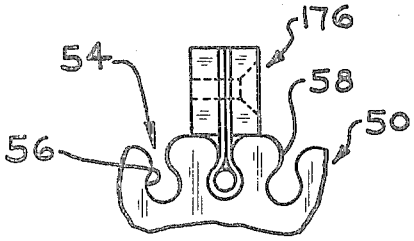
FIG. 9
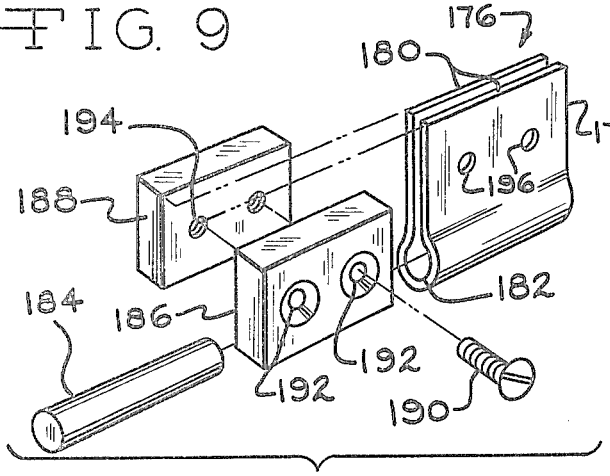
FIG. 10

APPARATUS FOR DESCALING METAL STRIPS

This invention relates to an apparatus for removing scale from metal, and specifically from hot rolled steel strips or sheets.

Heretofore, scale has usually been removed from hot rolled steel strips by pickling, which has a number of disadvantages. A pickling line is expensive and consumes considerable space, being several hundred feet long with a multi-million dollar cost. The operation is also hazardous because of the acid involved and considerably gas or oil energy is required. Shot-blasting has also been employed to some extent to remove scale, but has the disadvantage of tending to embed some of the scale into the surface of the strip, rather than knocking it off.

In accordance with the invention, an improved method and apparatus for removing scale from metal strips are provided. An abrasive roll is employed to accomplish this, the roll having a hub with a multiplcity of generally radially-extending flexible abrasive sheets held in longitudinal grooves in the hub with the abrasive surfaces facing in a common direction. The roll is rotated at high speed and the metal strip is directed past the roll in contact with outer edges of the flexible sheets which effectively remove the scale quickly, easily, and cleanly while having little, if any, effect on the metal surface under the scale. Particularly for a thinner metal strip, a single back-up roll supports the strip, being directly opposite the abrasive roll. The back-up roll preferably includes a plurality of plastic spacers on a supporting shaft to protect the shaft with two metal spacers or collars located at the ends of the plastic ones, adjacent the edges of the metal strips being descaled. The metal collars withstand abrasion when contacted by the edges of the abrasive sheets and can be readily replaced when worn.

In a preferred form, the abrasive roll and specifically the abrasive flexible sheets have a length less than the width of the metal strip. One end of the abrasive roll or sheets is maintained in alignment with one longitudinal edge of the steel strip. For this purpose, a sensing arm can be employed which moves transversely with the abrasive roll and a fluid-operated cylinder can be used to urge the arm against the longitudinal edge of the strip. The length of the abrasive sheets exceeds one-half the width of the metal strip so that the next abrasive roll on the same side of the strip can be positioned with ends of the sheets in alignment with the opposite longitudinal edge of the strip to remove the scale on the portion of the surface untouched by the first abrasive roll. A central portion of the strip will be contacted by both abrasive rolls but the overlapping portion from which the scale was removed by the first abrasive roll will not be affected by contact with the second abrasive roll. With this arrangement, the abrasive rolls and specificaly the flexible sheets never extend beyond the longitudinal edges of the strip, which tend to fray and wear the flexible sheets more than otherwise, and thereby reduce the life of the abrasive rolls.

For a relatively low production rate and to achieve substantially lower costs, a single abrasive roll with supporting means can be employed. The hot rolled strip is then passed therebetween with one surface in contact with the abrasive roll and the strip is then turned upside down and passed between the roll and back-up support in the same manner as the first pass.

To achieve this, the coil of strip can be unwound by being rotated in one direction when the strip is to be moved between the roll and the support, and is then wound into another coil rotated in the opposite direction. The resulting coil can be passed through again, with the surface opposite the first abraded surface being presented to the abrasive roll to descale that side to complete the operation on the strip.

It has been found where a multiplicity of abrasive sheets are used on a hub to constitute the abrasive roll, that the edges of the abrasive sheet in contact with the strip wear unevenly, with the result that the abrasive roll becomes out of balance after a period of operation. It has also been found that if this condition of imbalance is not corrected, the abrasive sheets wear even more severely, even causing the imbalance to be sufficiently severe to break the shaft. To overcome this, and also to prolong the operating life of the abrasive sheets, the roll is checked from time-to-time to determine its condition of balance. If out of balance, weights can then be added at appropriate positions on the ends of the hub beyond the abrasive sheets to restore the balanced condition.

When a supporting or back-up roll is located directly opposite the abrasive roll, metal collars can be employed on the supporting roll shaft near the edges of the steel strip being descaled to protect the shaft in the event that end portions of the abrasive sheets extend beyond the edges of the strip.

It is, therefore, principal object of the invention to provide an improved method and apparatus for removing scale from metal strips, which method and apparatus have the advantages and the features outlined above.

Other objects and advantages of the invention will be apparent from the following detailed description of preferred embodiments thereof, reference being made to the accompanying drawings, in which:

FIG. 5 is an end view taken in elevation of the apparatus of FIG. 3;

FIG. 7 is an end view in elevation of the apparatus of FIG. 6;

FIG. 9 is an enlarged, fragmentary end view of a hub of an abrasive roll, with a balancing weight assembled therewith;

FIG. 10 is an exploded view in perspective of the balancing weight of FIG. 9;

FIG. 11 is an enlarged view of a back-up or supporting roll used directly opposite the abrasive roll; and FIG. 12 is an enlarged view in transverse cross section taken along the line 12—12 of FIG. 11.

Figure 2:
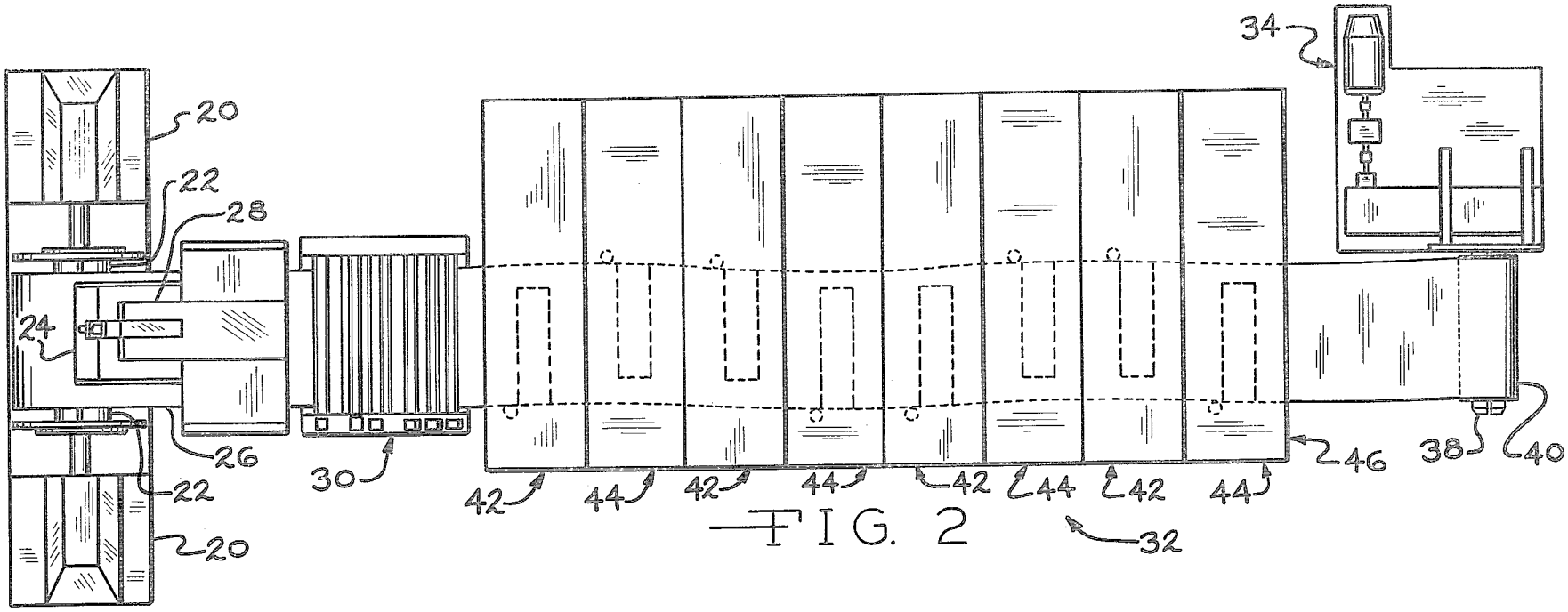
FIG. 2 is a schematic plan view of the line of FIG. 1.
Figure 1:
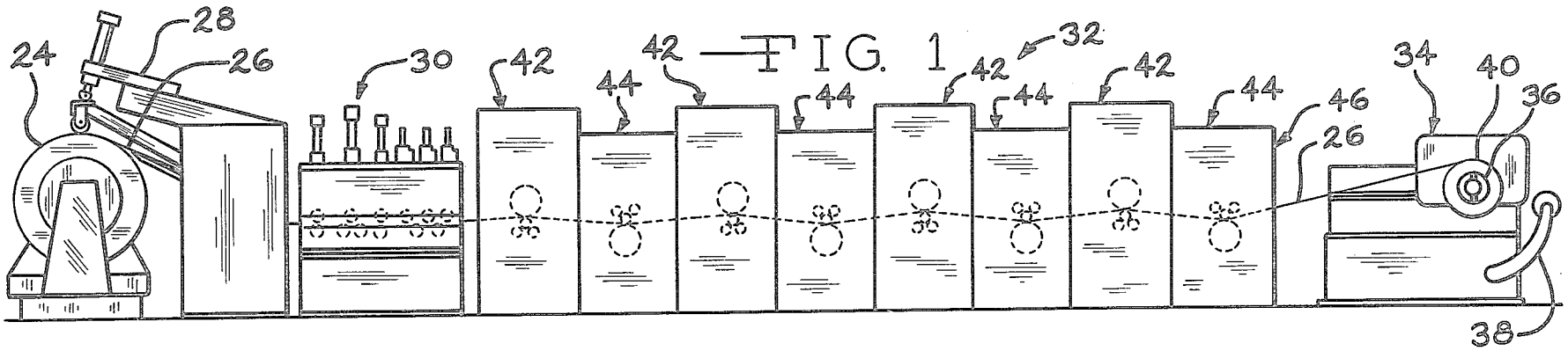
FIG. 1 is a schematic side view in elevation of an overall strip processing line embodying the invention.

Referring to FIGS. 1 and 2, the overall steel strip processing line includes a supply station 20 having expandable mandrels 22, which rotatably support a coil 24 of a strip or sheet of hot-rolled steel. A strip 26 of the steel is peeled from the coil 24 by a conventional peeler 28 and is directed by the peeler to a flattener 30 which includes pinch rolls and a process roll which bends the steel strip as it passes thereby and loosens the scale thereon. The flattener also includes straightener rolls which straighten the steel strip, as is well known in the art. Beyond the flattener 30 can be a shear which cuts off and squares the trailing and leading edges of the steel strip and a welder which welds the edges together. The shear and welder are also conventional and are not shown. Next is a descaling station 32, in accordance with the invention, and beyond that can be an optional dry lubricator station and pinch rolls and a shear which cuts out the weld between two coils by removing a portion six to eight inches wide. These components again are common to the processing line and are now shown. Finally, a recoiler 34 having an expandable mandrel 36 and an oiler 38 rewinds the processed steel strip into a coil 40.

The descaling station 32 contains four upper descaling units 42 which remove scale from the upper surface of the steel strip 26 and four lower descaling units 44 which remove scale from the lower surface of the steel strip. All eight of the units 42 and 44 are self-contained within a housing 46 to confine the scale particles and any other air-borne particles to a given space. A suitable exhaust system and dust-removal provisions (not shown) are provided for the housing 46.

Figure 3:
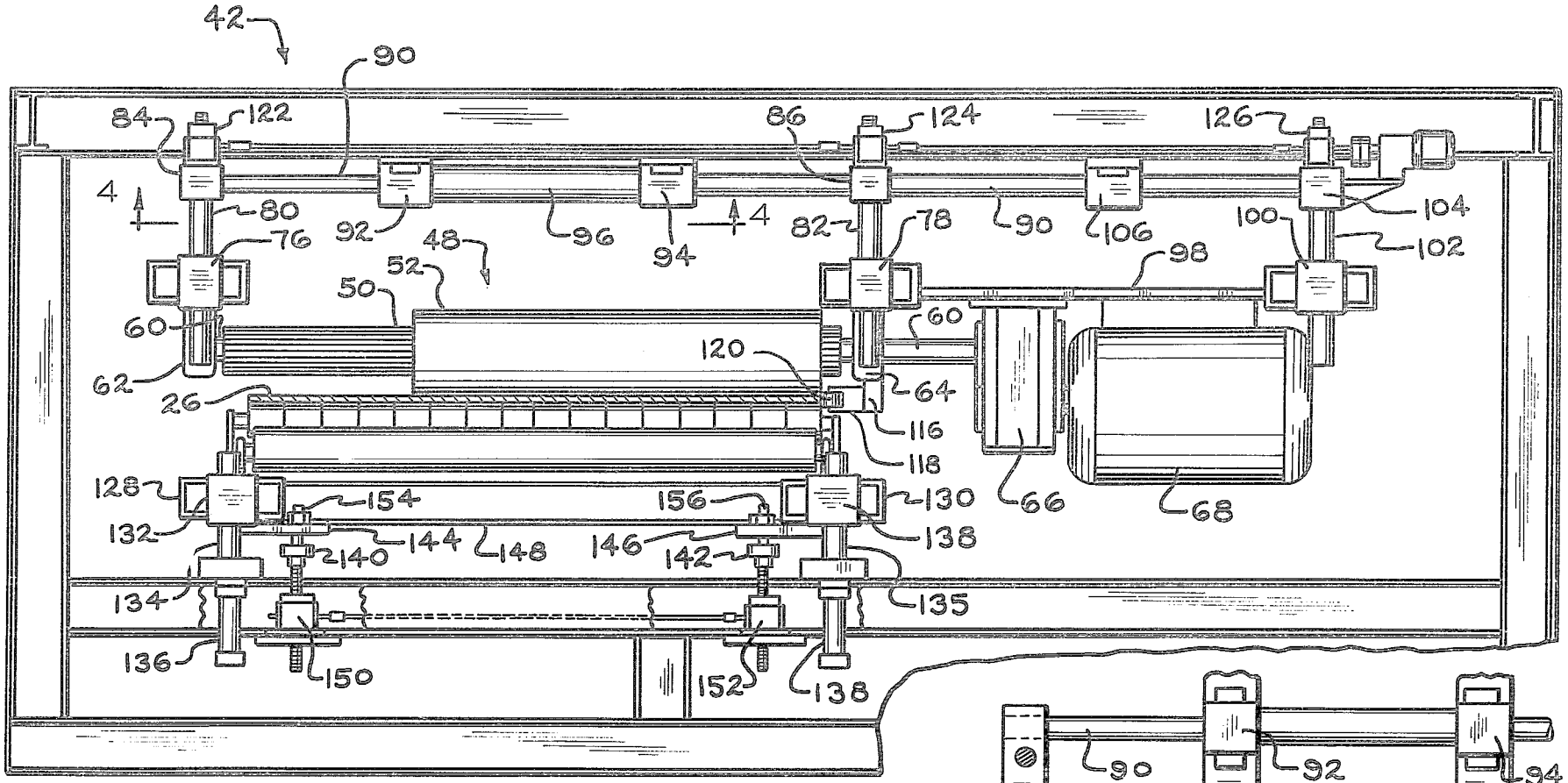
FIG. 3 is an enlarged, somewhat schematic side view in elevtion of an abrasive roll and related components for removing scale from a metal strip carried along the processing line.
Figure 4:
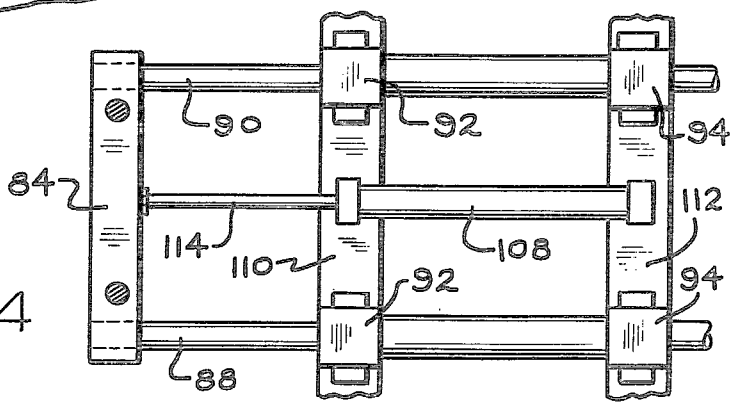
FIG. 4 is a view taken along the line 4—4 of FIG. 3.

Referring to FIGS. 3–5, the second or fourth one of the units 42 is shown in detail. The unit includes an abrasive roll 48 having a hub 50 and abrasive sheets 52 extending generally radially therefrom. Common sides of the sheet have abrasive particles thereon and the roll is positioned so that outer edge portions of the sheets contact the steel strip 26 as it passes thereby. The hub 50 has a multiplicity of longitudinally-extending grooves 54 therein (FIG. 9) having larger base portions 56 and narrower throats 58. Several of the abrasive sheets 52 are anchored in each of the grooves 54 with the hub 50 and the grooves 54 extending beyond both of the ends of the sheets 52.

The abrasive roll 48 is mounted on a shaft 60 which is rotatably journaled in depending bearing blocks 62 and 64 and driven at high speed, e.g. 2000 rpm, through a gear box 66 by a motor 68. Below the abrasive roll 48 are two back-up rolls 70 (FIG. 5) spaced on each side of a vertical line extending through the center of the roll 48. When these rolls are used, particularly for heavier strips, they will not be contacted by the abrasive sheets 52. However, especially for strips of thinner gauge, it is preferred to support the strip directly under the abrasive roll 48. For this purpose, a single back-up roll 72 is usually used, this being suitably journaled in end supporting plates 74 which are removable.

The back-up roll 72 and the abrasive roll 48 of the unit 42 are positioned out of alignment with the corresponding rolls of the adjacent units 44 so that the strip 26 bends or curves at the supporting roll 72 to present a convex surface toward the abrasive roll 48. This configuration of the strip tends to loosen the scale thereon so that it can be more easily removed by the abrasive roll 48. Also, the curved configuration of the strip 26 enables the abrasive roll 48 to concentrate the area of contact with the upper surface of the strip to be even more effective in removing the scale.

The abrasive roll 48 and the related components are supported for transverse movement relative to the strip 26. As shown exaggereated om FIG. 2, the strip 26 has a certain inherent amount of transverse waver or camber. Therefore, the roll 48 must be able to move transversely if it is to maintain a given relationship with respect to the strip 26. Accordingly, the bearing blocks 62 and 64 for the shaft 60 are affixed to sleeve bearings 76 and 78 which are mounted for vertical movement on vertical rods 80 and 82. These depend from cross frame members 84 and 86 which are affixed to horizontal rods or ways 88 and 90. These, in turn, are slidably carried and supported by sleeve bearing blocks 92 and 94 which are affixed to an overhead supporting beam 96 which constitutes a structural part of the housing 46. Also, the gear box 66 and the motor 68 depend from a supporting platform 98 which is affixed to the bearings 78 and additional bearings 100 which are mounted for vertical movement on vertical rods 102. These rods are affixed to a transverse frame member 104 which is also affixed to the horizontal ways 88 and 90, the ways being further supported by additional bearing blocks 106.

With this arrangement, the abrasive roll 48 and all of the related components can be moved back and forth on the ways 88 and 90 which are slidably carried by the bearing blocks 92, 94, and 106. To so move the abrasive roll and components, a fluid-operated cylinder 108 (FIG. 4) is provided. This cylinder is mounted on cross frame members 110 and 112 extending between the main beams 96 and has a piston rod 114 affixed to the end frame member 84. With fluid pressure applied to the blind end of the cylinder 108, the abrasive roll 48 is urged toward the left as viewed in FIG. 3, toward the strip 26.

The unit 42 has edge-sensing means in the form of a depending arm 116, which in this instance, is supported by one of the bearings 78 and has a horizontally-extending bracket 118 rotatably carrying a roller 120. The roller 120 contacts the right-hand longitudinal edge of the strip 26 as viewed in FIG. 3, and is maintained in engagement with that edge, even though the strip 26 has camber, by virtue of the pressure maintained in the blind end of the cylinder 108. With this arrangement, the right ends of the abrasive sheets 52 are always maintained in alignment with the longitudinal edge of the strip 26 so that the sheets will not extend beyond that edge and be subjected to undue wear. The opposite ends of the sheets 52 do not reach the opposite edge of the metal strip 26, having a length extending more than half of the width, but less than the entire width, of the strip 26. Consequently, neither of the ends of the abrasive sheets 52 ever extend beyond the longitudinal edges of the strip 26 so that they are not subjected to the undue wear which can otherwise occur to the abrasive sheets at the edges of the metal strip.

As the abrasive sheets 52 wear, the abrasive roll 48 is adjusted vertically. To accomplish this, a plurality of jackscrews 122, 124, and 126 are affixed to the bearing blocks 62 and 64 and to a transverse frame member (not shown) between the vertical rods 102. These are discussed in more detail in my co-pending application, Ser. No. 381,879, filed July 23, 1973, and will not be discussed further.

When the steel strip 26 is stopped for any reason, such as when the trailing end is reached, so that the leading end of another strip can be welded thereto, the strip 26 must be separated from the abrasive roll 48. Accordingly, the back-up rolls 70 and 72 are mounted on bearing blocks 128 and 130 which are mounted for vertical movement by sleeve bearings 132 and 133 on vertical rods 134 and 135. The blocks 128 and 130 are mounted on fluid-operated rams or cylinders 136 and 138 to quickly lower the blocks and the rolls 70 and 72 when fluid is supplied to the rod ends thereof. The extent to which the back-up rolls are lowered or dropped is determined by adjustable stops 140 and 142 which engage stop plates 144 and 146 located below longitudinally-extending frame members 148. The stops 140 and 142 are mounted on jackscrews 150 and 152 so that they can be raised and lowered corresponding amounts, the jackscrews being mechanically connected together for equal movement. Additional adjustable stops 154 and 156 are also located on the jackscrews 150 and 152, above the plates 144 and 146. These stops can be adjusted independently of the stops 140 and 142 to determine the operating position of the back-up rolls 70 and 72 relative to the strip 26 and the abrasive roll 48.

Figure 6:
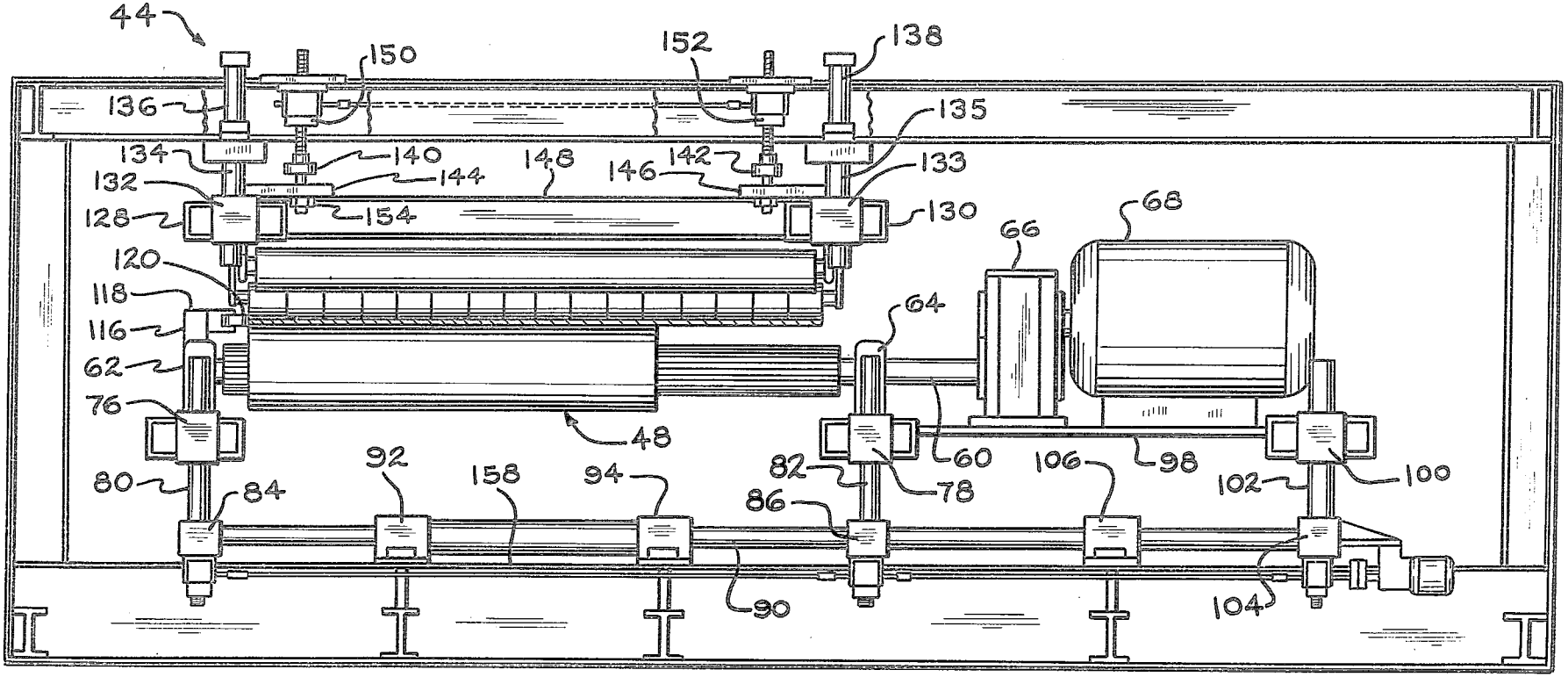
FIG. 6 is a somewht schematic side view in elevation of another abrasive roll and related components, this roll being on the opposite side of the strip from that shown in FIG. 3.

One of the lower units 44, and specifically the second or fourth one, is shown in FIGS. 6 and 7. The unit 62 includes one of the abrasive rolls 48 which is mounted on the shaft 60 rotatably journaled in the bearing blocks 62 and 64. The roll is driven through the gear box 66 and the motor 68. Above the abrasive roll 48 are the back-up rolls 70 and 72, the latter being rotatably carried by the end plates 74. The bearing blocks 62 and 64 have the sleeve bearings 76 and 78 mounted on the vertical rods 80 and 82 which extend upwardly from the cross frame members 84 and 86. The frame members are mounted on the horizontal rods or ways 88 and 90 extending through the bearing blocks 92 and 94 which are affixed to a lower supporting beam 158, in this instance.

The gear box 66 and the motor 68 for the unit 44 are supported on the platform 98 which is affixed to the bearings 78 and the bearings 100, the latter being mounted for vertical movement on the vertical rods 102. The rods 102 are affixed to the transverse frame member 104 which is also affixed to the horizontal ways 88 and 90, these being supported in the bearing blocks 92 and 94 and the bearing blocks 106. The abrasive roll 48 for the unit 44 can be moved transversely on the ways 88 and 90 by the cylinder 108 which can have the piston rod connected to the end frame member 84. When fluid under pressure is supplied through the rod end of the cylinder 108, in this instance, the roller 120 carried by the bracket 118 on the arm 116 bears against the left longitudinal edge of the metal strip 26, in this instance, to maintain the left ends of the abrasive sheets 52 in alignment with the left longitudinal edge of the strip. Again, the length of the abrasive sheets 52 is less than the width of the strip 26, but more than one-half of the strip width.

The abrasive roll 48 for the unit 44 again can be adjusted vertically to accommodate wear, the jackscrews 122, 124, and 126 being provided for this purpose.

The back-up rolls 70 and 72 again are mounted on the blocks 128 and 130 which can be vertically moved by the bearings 132 and 133, slidably mounted on the vertical rods 134 and 135. The blocks 128 and 130 can be quickly raised by the fluid-operated rams or cylinders 136 and 138 when the strip 26 is stopped, with the extent of the retraction or raising determined by the adjustable stops 140 and 142 which engage the stop plates 144 and 146 above the frame member 148. The stops 140 and 142 are mounted on the jackscrews 150 and 152 and are raised and lowered jointly, as before. The additional stops 154 and 156 determine the position of the back-up rolls relative to the strip and are independently adjusted relative to the stops 140 and 142.

When the metal strip 26 is stopped, it is raised to space it from the lower abrasive roll 48. For this purpose, fluid-operated rams can be located below the strip adjacent the lower roll and operated to raise the strip when it is stopped, the extent of movement being limited by the adjustable stops 140 and 142. This is disclosed more fully in the aforesaid co-pending application and is not shown here.

Figure 8:
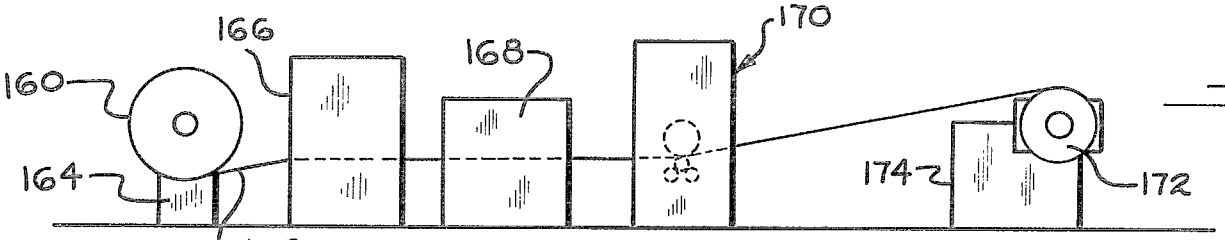
FIG. 8 is a schematic side view in elevation of modified apparatus employing a single abrasive roll.

In some instances, a single head abrasive unit can be used, as shown in FIG. 8. Such a unit requires that the steel strip be passed through the unit twice, to descale both surfaces. Consequently, the production rate of such a unit is substantially less than that of the apparatus 32 of FIGS. 1 and 2. However, the single head unit also is substantially less expensive and requires a substantially lower capital investment. Referring to FIG. 8, a coil 160 of a steel strip 162 is located at a supply station 164 where the strip is unwound from the bottom of the coil, the coil rotating in a counterclockwise direction. The strip 162 can pass through a peeler 166 and a straightener 168 to an abrading station 170. Here, the station 170 comprises a unit similar to the unit 42 of FIG. 3 except that the abrasive sheets extend the full width of the strip 162 in order to cover both surfaces thereof in two passes. The strip is then wound onto a receiving coil 172 at a winding station 174 with pinch rolls located between the station 170 and the coil 172, if desired, to move the strip. The strip 162, in this instance, is wound onto the top of the coil 172 which is rotated in a clockwise direction. When the strip 162 has been wound into the coil 172, the coil is then moved back to the station 164 and the strip 162 unwound from the bottom and passed through the line and again wound onto the top of the coil at the winding station. Hence, with two passes, the strip is completely descaled. The strip 162 is wound onto a point of the coil 172 at substantially 180° from the point of unwinding from the supply coil 160. Also, the coil 172 is always rotated in a direction opposite to the coil 160 to present the opposite surface to the abrasive roll during the second pass.

The abrasive sheets 52 of the abrasive roll 48 wear over a period of time and do not wear evenly with the result that the roll becomes out of balance. Further, the condition of imbalance is accentuated as the rolls wear more and this increases the unevenness of wear of the sheets. In fact, it has been found that the imbalance can become so great as to break the shaft 60 on which the hub 50 is mounted. To overcome this problem, the condition of balance of the abrasive roll 48 is checked periodically with a strobe light or other suitable means. When the roll is found to be out of balance, weights are added to the hub 50 to restore balance. One effective weight for accomplishing this is shown in FIGS. 9 and 10. Here, a weight assembly 176 comprises a heavy flexible sheet 178 which is doubled back on itself to form two webs 180 connected by a loop 182. A tubular member 184 is inserted into the loop 182 to maintain the shape thereof and the sheet and the tube are then inserted in the end of the groove 54 in the hub 50. The tube 184 has a diameter exceeding the diameter of the throat 58 of the groove to maintain the weight assembly therein. Weights 186 and 188 are assembled with the web 180 by fasteners 190 inserted through countersunk openings 192 in the weight 186 and into tapped openings 194 in the weight 188 after the fasteners extend through aligned openings 196 in the webs 180. The weight assembly 176 is of a length less than the length of the portions of the grooves extending beyond the abrasive sheets 52 of the roll 48 so that the weight assemblies can be inserted in the grooves 54 at both ends of the abrasive roll 48. The weight assemblies are securely held in the grooves 54 without requiring any tools and with the use of a minimum amount of labor.

In some installations, it may be desirable for the abrasive sheets 52 of the roll 48 to extend beyond the longitudinal edges of the metal strip 26. This can occur with the single roll embodiment of FIG. 8 where the abrasive sheets must have a length at least equaling the width of the metal strip 26 and it can also occur where the sheets are oscillated transversely of the metal strip, as discussed in the aforesaid co-pending application. In such instances, it is necessary, when the single back-up roll 72 is employed to protect the roll from the sheet. For this purpose, a modified back-up roll 198 of FIGS. 11 and 12 is employed. The roll 198 includes a central shaft 200 having reduced end portions 202 rotatably received in the supporting plates 74. A plurality of plastic spacers or collars 204 are located on the shaft 200 with metal end collars 206 located in the vicinity of the edges of the metal strip. Each of the metal collars 206, as shown in FIG. 12, has a slit 208 with adjacent portions of the collar being connected by a machine screw 210. The collar thereby can be slipped over the end of the shaft 200 and the machine screw tightened when the collar is in the desired position. The collar thus can be replaced occasionally when necessary. Of course, the spacers 204 can also be of metal, but the plastic is satisfactory since these collars are not subjected to abrasion.

Various modifications of the above-described embodiments of the invention will be apparent to those skilled in the art and it is to be understood that such modifications can be made without departing from the scope of the invention, if they are within the spirit and the tenor of the accompanying claims.

I claim:

1. Apparatus for removing scale from a metal strip, said apparatus comprising an abrasive roll having a hub and a multiplicity of flexible sheets extending generally radially from said hub, said sheets having lengths which are less than the width of the metal strip, and having abrasive surfaces facing in a common direction, means for rotating said hub at high speed in the common direction, means for supporting the metal strip in contact with outer edge portions of said flexible sheets, means for moving the metal strip in a given direction between said flexible sheets and said supporting means, means mounting said abrasive roll for movement in an axial direction transverse to the direction of movement of the strip, and means movable in an axial direction with said abrasive roll for maintaining common ends of said flexible sheets substantially in alignment with a longitudinal edge of the metal strip.

2. Apparatus according to claim 1 wherein said last-named means comprises sensing means movable with said roll and positioned to engage the longitudinal edge of the metal strip, and means for urging said roll toward the metal strip to maintain the sensing means in contact with the edge thereof.

3. Apparatus according to claim 2 characterized by said urging means comprises a fluid-operated cylinder.

4. Apparatus according to claim 1 characterized by the length of said sheets being more than one-half the width of the metal strip.

5. Apparatus according to claim 1 characterized by a second abrasive roll having a second hub and a second multiplicity of second flexible sheets extending generally radially from said hub, said second flexible sheets having lengths which are less than the width of the metal strip, and having abrasive surfaces facing in a common direction, second means for rotating said second hub at high speed in the common direction, second means for supporting the metal strip in contact with outer edge portions of said second flexible sheets, and means for maintaining common ends of said second flexible sheets substantially in alignment with the other longitudinal edge of the metal strip.

6. Apparatus according to claim 5 wherein said last-named means comprises second sensing means movable with said second roll and positioned to engage said other longitudinal edge of the metal strip, and second means for urging said second roll toward the metal strip in a direction opposite to the direction of urging by the first urging means to maintain said second sensing means in contact with said other edge of the metal strip.

7. Apparatus according to claim 6 characterized by the length of the second flexible sheets being more than one-half the width of the metal strip.

8. Apparatus for removing scale from a metal strip, said apparatus comprising an abrasive roll, means for rotating said roll at high speed, means for supporting the metal strip in contact with said abrasive roll, means for moving the metal strip in a given direction between said abrasive roll and said supporting means, the length of said abrasive roll not exceeding the width of the metal strip, and means for maintaining an end of said abrasive roll substantially in alignment with a longitudinal edge of the metal strip and comprising sensing means movable with said roll and positioned to engage the longitudinal edge of the metal strip, and means for urging said roll toward the metal strip to maintain the sensing means in contact with the edge thereof.

9. Apparatus according to claim 8 characterized by a second abrasive roll, means for rotating said second roll at high speeds, means for supporting the metal strip in contact with said second abrasive roll, the length of said second abrasive roll not exceeding the width of the metal strip, and second means for maintaining an end of said second abrasive roll substantially in alignment with the other longitudinal edge of the metal strip.

10. Apparatus according to claim 9 wherein said last-named means comprises second sensing means movable with said second roll and positioned to engage said other longitudinal edge of the metal strip, and means for urging said second roll toward the metal strip to maintain the second sensing means in contact with said other edge thereof.

11. Apparatus for removing scale from a metal strip, said apparatus comprising a hub, a multiplicity of flexible sheets extending generally radially from said hub, each of said flexible sheets having an abrasive surface facing in a common direction, means for rotating said hub at high speed in the common direction, means for supporting a metal strip with portions in contact with outer edge portions of said flexible sheets, said hub having a multiplicity of longitudinal-extending grooves therein, weight means engageable with said hub beyond the ends of said flexible sheets for balancing said hub and said sheets, said weight means comprising a web having an enlarged portion engageable in one of said hub grooves, a weight affixed to an outer portion of said web, and means for moving the metal strip in a given direction between said flexible sheets and said supporting means.

12. Apparatus according to claim 11 charracterized by said enlarged portion including a rod member having a diameter exceeding the narrowest dimension across said one hub groove.

* * * * *